US005987823A

United States Patent [19]

Zarnick

[11] Patent Number: 5,987,823

[45] Date of Patent: Nov. 23, 1999

[54] CONTROLLING ACOUSTIC AND EMISSIVITY IN SPORTS ARENAS AND CONCERT HALLS IN WARM CLIMATES IN AIR CONDITIONING MODE

[76] Inventor: Bernard F. Zarnick, MBI, 5309 Hamilton Ave., Cleveland, Ohio 44114-3909

[21] Appl. No.: 08/686,733

[22] Filed: Jul. 26, 1996

Related U.S. Application Data

[63] Continuation-in-part of application No. 08/432,606, May 1, 1995, abandoned.

[51] Int. Cl.[6] ..... E04B 1/88; E04B 9/00; E04H 3/10

[52] U.S. Cl. ..... 52/6; 52/144

[58] Field of Search ..... 52/144, 6, 22, 52/506.06; 181/210, 284, 286, 291, 294, 287

[56] References Cited

U.S. PATENT DOCUMENTS

| | | | |
|---|---|---|---|
| 2,527,031 | 10/1950 | Rambusch | 181/294 |
| 3,021,914 | 2/1962 | Wilson | 181/290 |
| 3,049,190 | 8/1962 | Coffman | 181/287 |
| 3,255,687 | 6/1966 | Glaser | 181/286 |
| 3,321,877 | 5/1967 | Alexieff | 181/284 |
| 3,469,354 | 9/1969 | Meeyze, Jr. | 52/6 |
| 4,137,678 | 2/1979 | Varlonga | 52/144 |
| 4,531,609 | 7/1985 | Wolf et al. | 181/286 |

*Primary Examiner*—Michael Safavi

[57] ABSTRACT

An arena includes a performance area and an audience area having a ceiling extending thereover. A plurality of first insulating elements having high acoustic characteristics and low emissivity are mounted in a portion of the ceiling extending over the performance area and a plurality of second insulating elements having high acoustical characteristics and high emissivity are mounted in a portion of the ceiling extending over the audience area.

2 Claims, 4 Drawing Sheets

TYPE 1

| TYPE | ACOUSTICS | EMISSIVITY | COLOR | EVENT/HEATING/COOLING |
|---|---|---|---|---|
| 1A | VERY GOOD ACOUSTICS HIGH ABSORPTION | HIGH EMISSIVITY | BLACK | IDEAL IN COLD CLIMATES DURING HEATING CYCLES |
| 1B | VERY GOOD ACOUSTICS HIGH ABSORPTION | LOW EMISSIVITY | SILVER | IDEAL IN WARM CLIMATES DURING COOLING CYCLES- HOCKEY FACILITIES ONLY |

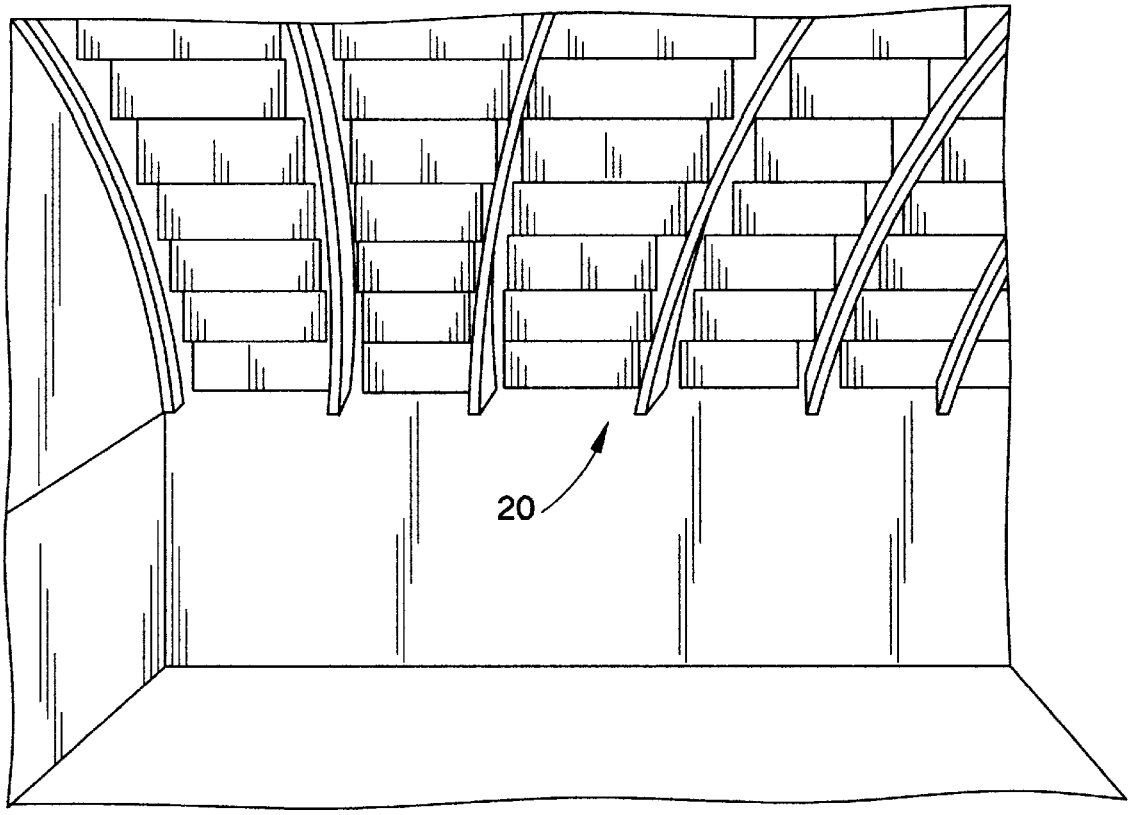
FIG.3
FIG.4
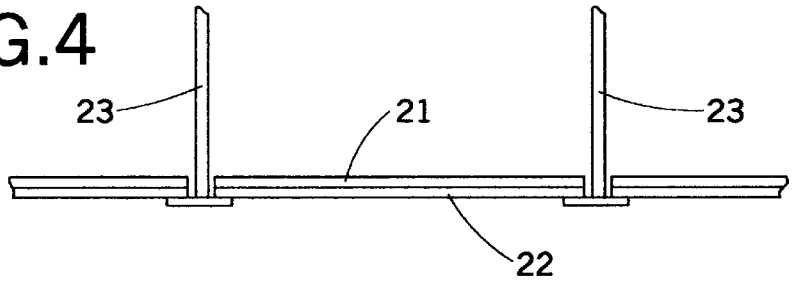
FIG.5
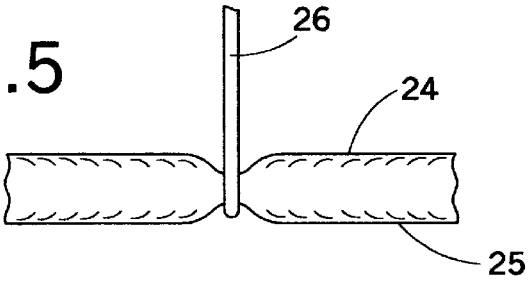

CONTROLLING ACOUSTIC AND EMISSIVITY IN SPORTS ARENAS AND CONCERT HALLS IN WARM CLIMATES IN AIR CONDITIONING MODE

This application is a continuation in part of my application Ser. No. 08/432,606 filed May 1, 1995, now abandoned.

BACKGROUND OF THE INVENTION

The present invention relates to an arena having a ceiling structure with improved acoustic and emissivity characteristics.

In an arena, such as a sports arena, particularly adapted for hockey and basketball in warm climates operating in an air conditioning mode, there is a need to keep the fans comfortable while operating the air conditioning system efficiently at low cost. Air in the upper reaches of an arena can rise to 95° F. to 115° F. at times.

SUMMARY OF THE INVENTION

This invention relates to the treatment of insulating elements such as panels, curtain baffles, banners and rolling curtains which will reradiate a low percentage of heat to an ice or other surface in a performance area of an arena so that the refrigeration load will not increase undesirably, particularly in warm climates such as the southern part of the United States, when operating in an air conditioning mode. Also this invention relates to controlling the acoustics of an excited crowd when cheers bounce off baffles, banners, pulling curtains or ceiling panels of acoustical insulation having 1–3 mils of a coating loosely covering fiberglass insulation 4 to 6 pounds per sq. ft. This decreases the noise by absorbing part of the noise while the coating has a low emissivity whereby only 0–7% of the heat is reradiated to the ice and or other performance area.

BRIEF DESCRIPTION OF THE DRAWINGS

FIG. 3 is a view of a portion of a ceiling of an arena having hanging baffles or banners;

FIG. 4 is a view of hanging ceiling panels supported by hangers;

FIG. 5 is a view of a hanging batt of fiberglass having a covering thereon and supported by a hanger.

DETAILED DESCRIPTION OF THE PREFERRED EMBODIMENTS

A suitable first insulating element designated as Type 1B has the characteristics as shown in the table below.

FIXED (NON VARIABLE) EMISSIVITY AND ACOUSTICS

| TYPE | ACOUSTICS | EMISSIVITY | EVENT/HEATING/ COOLING |
|---|---|---|---|
| 1B | Very Good Acoustics High Absorption | Low Emissivity | Ideal in warm climates during cooling cycles-Hockey facilities only |

Figure 2:
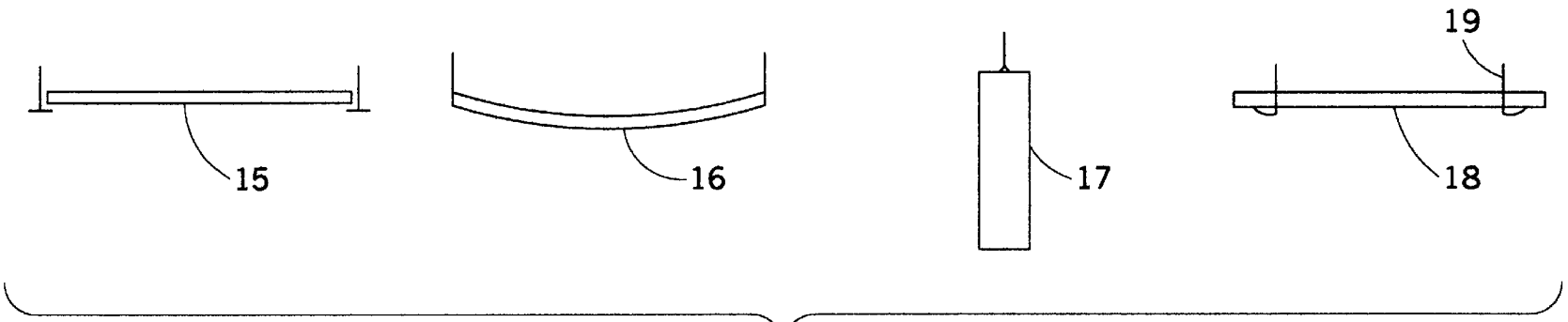
FIG. 2 is a schematic view of various ceiling elements which will accomplish the emission and acoustical conditions of the invention and also includes a table showing the acoustical and emissivity characteristics of type 1A and 1B insulating elements.

This element is particularly good when coated with a silver finish which provides low emissivity. A suitable second insulating element designated as type 1A has the characteristics as shown in the table of FIG. 2.

These insulating elements may be catenary banners, baffles or flat ceiling panels. With careful control of the emissivity of the material of the insulating elements in the ceiling it is possible to save 50% of the refrigerant load which converts to a large power bill saving. Compressed fiberglass used in these insulating elements may contain 3# to 6#/cubic foot fiberglass when the elements are rigid insulation.

If a coating over this insulation is from 1–3 mils thick and has an appropriate emissivity, then the coating or film will absorb noise and dissipate it with the insulation. If glue is used to completely fasten the coating to the insulation, the sound will bounce back and not be dissipated in the insulation. This would be acoustically opaque. The opposite to this is transparent to sound.

When low Ec is referred to, it means that very little of the heat or radiation, perhaps 0–3%, is reradiated to the floor of the arena. Aluminum or silver may be used interchangeably as a coating though silver is much more expensive.

When referring to high emissivity, reference is being made to black with a 98% emissive characteristic; that is 98% of the heat or radiation is reradiated. From a practical point of view, gray and other colors such as yellow, red, etc. will reradiate 95% of heat so it is not significant from the heat balance stand point to use the entire spectrum of colors from black to gray to yellow, red and white since the heat balance will not be significantly different.

In planning to balance the heat load low Ec material, i.e., low emissive coverings are used that will reradiates very low amounts of heat to a surface such as a hockey rink where the ice of the rink is 26–30° F. By using a material having low emissivity, the refrigeration load is saved or reduced by as much as 50%. On the other hand, over the patrons in the seats in the audience portion of the arena, high radiation material such as a black material is desirable to keep the patrons warm. At 150 feet in the air a ceiling can be 95° F. to 115° F. with natural convection. In an air conditioning mode, low Ec is desirable so that patrons do not swelter.

In the design of arenas, there are a great number of problems concerning noise, acoustical vibration and reradiation emitted from the ceiling, dependent on whether or not the coating material is silver or aluminum whereby the Ec or emissivity is low, such as 0–3%.

If it is desired to keep an arena ice surface at 26°–30° F., low Ec material should be used so that the heat in the ceiling of the arena is kept from reradiating to the ice.

Figure 1:
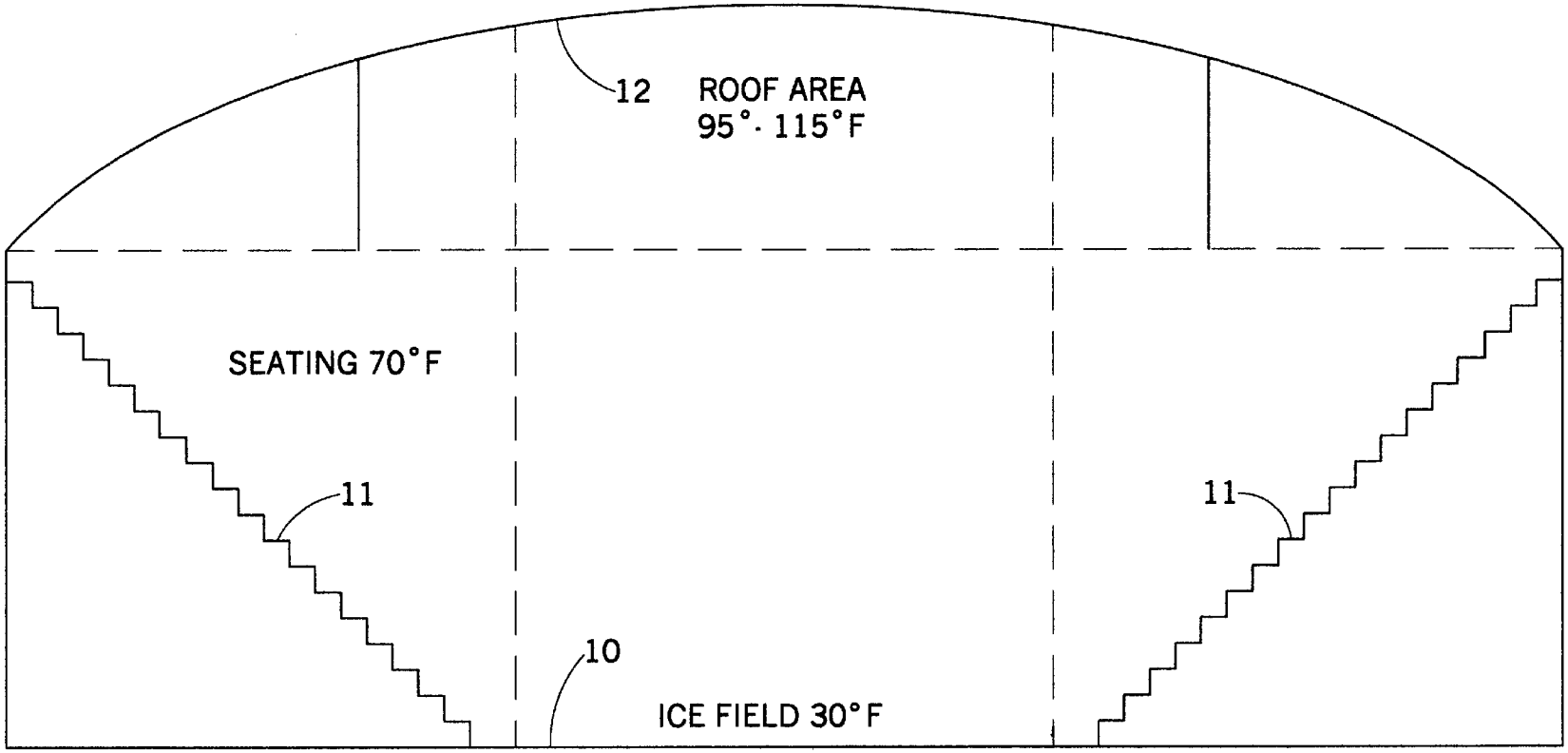
FIG. 1 is a schematic view of an arena showing a performance area such as an ice surface and an audience or seating area.

Referring to FIG. 1, the ice field or rink 10 will be kept at 26° to 30° F. Preferable, the seating 11 will be kept at 70° F. The roof or ceiling area 12 can rise to 95° F. to 115° F. when heated. On a hot day with the sun beating down and even in an air condition mode, the temperature can rise to 115° F. Use of an insulating element having a coating with a low Ec in the ceiling area over the ice rink will allow the ice to stay cold, i.e. 26°–30° F., with as much as 50% savings in refrigeration load. The panels over the seats or audience area preferably have a high emissivity so the audience area below may be kept warmer.

FIG. 2 includes a schematic view of a number of panels or insulating elements that meet the requirements of this invention. The element 15 is a flat ceiling panel of fiberglass covered with an aluminum or silver coating. A catenary banner is shown at 16 which is supported at each end by suitable means such as hangers. The element 17 is a baffle or banner which is 1" to 4" thick of fiberglass insulation covered with 1–3 mils of silver or aluminum cloth which has low Ec such as 0–3% and good acoustical characteristics, i.e. high absorption. The element 18 is a panel similarly covered with a coating and supported by metallic stick clips 19. FIG. 2 also includes a table showing the acoustical and emissivity characteristics of type 1A and 1B insulating elements.

FIG. 3 illustrates an installation of banners or baffles 20 which hang from the ceiling and are 4'×10' or more in size. Baffles have a rigid core. Banners are flexible. Both baffles and banners, however, incorporate fiberglass with 1–3 mils of a low Ec covering.

FIG. 4 illustrates a hanging ceiling panel 21 of fiberglass with a silver or aluminum covering 22 which has a low Ec, i.e., 0–3%, and which is supported by hangers 23.

FIG. 5 illustrates an acoustical batt 24 of fiberglass covered with a material 25 having a low Ec and which is supported by hanger 26.

Figure 6:
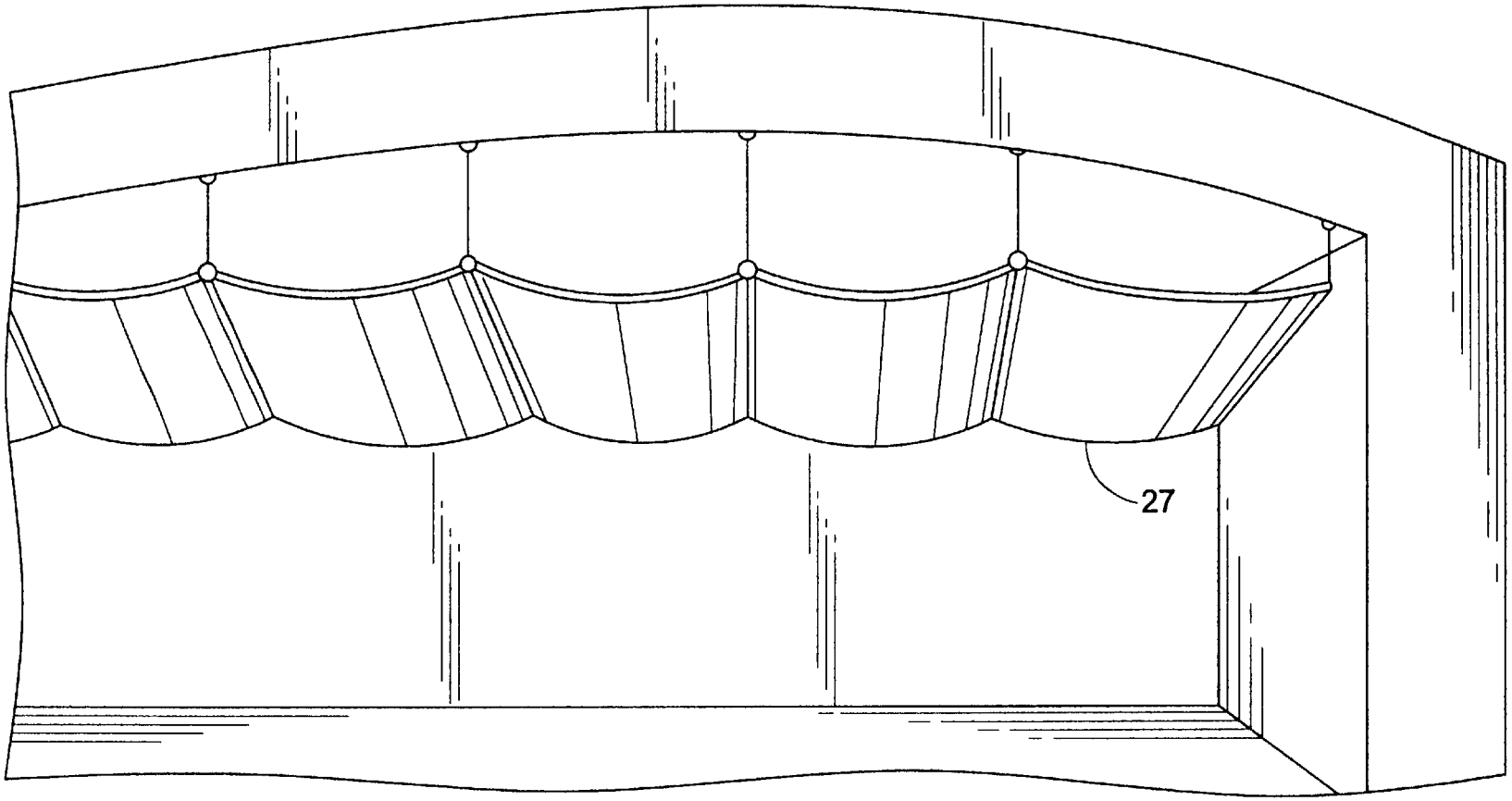
FIG. 6 is a view of a ceiling of an arena having hanging festoon panels.

FIG. 6 illustrates a ceiling of an arena having hanging festooned members 27 comprised of insulation and a low Ec covering.

With this assembly of ceiling members, it is possible to reduce reradiation to the ice and keep noise controlled by the thickness of the insulation while keeping the heat out on a hot day and the opposite on a cold day. The insulation serves as thermal insulation and noise control.

Numerous other modifications and adaptations of the present invention will be apparent to those skilled in the art and thus, it is intended by the following claims to cover all such modifications and adaptations which fall with the true spirit and scope of the invention.

I claim:

1. An arena comprising a performance area;

an audience area;

a ceiling extending over both said performance area and said audience area;

a plurality of first insulating elements having high acoustic characteristics and an emissivity of 7% or less mounted in a portion of said ceiling extending over said performance area;

each of said first insulating elements comprising a layer of fiberglass having a coating of either aluminum or silver thereon, which is loosely attached to said layer of fiberglass; and a plurality of second insulating elements having high acoustic characteristics and an emissivity of at least 95% mounted in a portion of said ceiling extending over said audience area, each of said second insulating elements comprising a layer of fiberglass having a coating of a material with an emissivity of at least 95% thereon which is loosely attached to said layer of fiberglass of said second insulating element.

2. An arena according to claim 1 wherein said layers of fiberglass of said first and second insulating elements are from 1 to 4 inches thick and said coatings are from 1 to 3 mils thick.

* * * * *